US007557756B2

(12) United States Patent
Iwata et al.

(10) Patent No.: US 7,557,756 B2
(45) Date of Patent: Jul. 7, 2009

(54) FLAT ANTENNA APPARATUS

(75) Inventors: Hideki Iwata, Shinagawa (JP); Masahiro Yanagi, Shinagawa (JP); Shigemi Kurashima, Shinagawa (JP); Takashi Yuba, Shinagawa (JP); Masahiro Kaneko, Shinagawa (JP); Yuriko Segawa, Shinagawa (JP); Takashi Arita, Shinagawa (JP)

(73) Assignee: Fujitsu Component Limted, Tokyo (JP)

( * ) Notice: Subject to any disclaimer, the term of this patent is extended or adjusted under 35 U.S.C. 154(b) by 78 days.

(21) Appl. No.: 11/590,743

(22) Filed: Nov. 1, 2006

(65) Prior Publication Data

US 2007/0262902 A1 Nov. 15, 2007

(30) Foreign Application Priority Data

May 10, 2006 (JP) ..... 2006-131699

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/702, 343/700 MS

See application file for complete search history.

(56) References Cited

U.S. PATENT DOCUMENTS

| | | | | |
|---|---|---|---|---|
| 5,382,930 | A * | 1/1995 | Stokes et al. | 333/191 |
| 5,525,942 | A * | 6/1996 | Horii et al. | 333/134 |
| 5,834,994 | A * | 11/1998 | Shapiro | 333/202 |
| 6,765,458 | B2 * | 7/2004 | Yamaguchi | 333/175 |
| 7,180,473 | B2 * | 2/2007 | Horie et al. | 343/909 |
| 7,289,070 | B2 * | 10/2007 | Yanagi et al. | 343/702 |
| 2003/0076199 | A1 * | 4/2003 | Yamaguchi | 333/175 |

FOREIGN PATENT DOCUMENTS

| | | |
|---|---|---|
| JP | 2000-196327 | 7/2000 |
| JP | 2005-160286 | 6/2005 |

OTHER PUBLICATIONS

Takuya Taniguchi et al., "An Omnidirectional and Low-VSWR Antenna for the FCC-Approved UWB Frequency Band", *2003 IEEE AP-S International Symp.*, vol. 3, pp. 460-463, Jun. 22-27, 2003.

* cited by examiner

*Primary Examiner*—HoangAhn T Le
(74) *Attorney, Agent, or Firm*—Staas & Halsey LLP

(57) ABSTRACT

A UWB flat antenna apparatus is disclosed. The UWB flat antenna apparatus includes an antenna element pattern, a ground pattern, and a multiple-stage filter including plural filter elements. Therein, the filter elements are electrically connected in series and are stacked, and the multiple-stage filter and the ground pattern are stacked.

6 Claims, 16 Drawing Sheets

FLAT ANTENNA APPARATUS

BACKGROUND OF THE INVENTION

1. Field of the Invention

The present invention generally relates to a flat antenna apparatus, and especially relates to a flat antenna apparatus for UWB (ultra-wide band).

2. Description of the Related Art

In recent years and continuing, UWB radio communication technologies attract attention for their capabilities of RADAR positioning and large capacity transmission. Especially, since the approval by the U.S. FCC (Federal Communication Commission) in 2002 of UWB for public uses in a frequency band between 3.1 and 10.6 GHz, developments are being actively undertaken for utilization of UWB.

Since UWB uses a super-wide band, the antenna apparatus for UWB must be capable of super-wideband transmission and reception.

An antenna for use at the FCC approved 3.1-10.6 GHz band proposed by Non-Patent Reference 1 includes a ground plane and a feeder.

FIG. 1A and FIG. 1B show conventional antenna apparatuses 10 and 20, respectively. The antenna apparatus 10 includes a ground plane 11 and a feeder 12 that is shaped like a reversed circular cone provided on the ground plane 11. The side face of the circular cone shape of the feeder 12 has an angle θ to the axis of the circular cone. By adjusting the angle θ, a desired characteristic is acquired.

The antenna apparatus 20 includes a feeder 22 in the shape of a teardrop, configured by a circular cone 22*a* and a sphere 22*b* inscribing the circular cone 22*a*; the feeder 22 is arranged on the ground plane 11.

[Non-Patent Reference 1]

"An omnidirectional and low-VSWR antenna for the FCC-approved UWB frequency band" by T. Taniguchi and T. Kobayashi (Tokyo Denki University) in 2003 IEEE AP-S International Symp., volume: 3, pp. 460-463, Jun. 22-27, 2003. (Disclosure on March 22 at B201 classroom).

[Patent Reference 1] JPA 2000-196327.

The conventional antenna apparatuses tend to require a great volume because of the feeder of the circular cone or the teardrop being arranged on the ground plane; accordingly, miniaturization and a thinner shape are desired.

FIG. 2 shows a UWB flat antenna apparatus 30 disclosed by JPA 2005-160286 filed by the applicant hereto.

The UWB flat antenna apparatus 30 includes a substrate 31 made from dielectric material, the substrate 31 having an upper surface 31*a* and a bottom surface 31*b*. On the upper surface 31*a*, an antenna element pattern 32 and a line 33 (the line 33 including line sections 33*a*, 33*b*, 33*c*, and 33*d*) are formed. The line 33 extends from the antenna element pattern 32 that is shaped like a home base. Further, a three-stage ring filter 34 consisting of ring filter elements 35, 36, and 37 is formed between the corresponding line sections 33*a*, 33*b*, 33*c*, and 33*d*. Each of the ring filter elements 35, 36, and 37 has a stub. On the bottom surface 31*b* a ground pattern 38 is formed. The antenna element pattern 32 and the ground pattern 38 are closely arranged in a longitudinal direction of the substrate 31.

As compared with the conventional antenna apparatuses 10 and 20 shown in FIGS. 1A and 1B, respectively, the UWB flat antenna apparatus 30 is miniaturized and thin.

Nevertheless, the ring filter 34 with stubs is structured by multiple flat ring filter elements with stubs, namely, a ring filter element 35 with a stub serving as the first stage, a ring filter element 36 with a stub serving as the second stage, and a ring filter element 37 with a stub serving as the third stage. For this reason, the length L of the UWB flat antenna apparatus 30 tends to be great, which makes it difficult to miniaturize the UWB flat antenna apparatus 30.

SUMMARY OF THE INVENTION

The present invention provides a flat antenna apparatus that substantially obviates one or more of the problems caused by the limitations and disadvantages of the related art.

Features of embodiments of the present invention are set forth in the description that follows, and in part will become apparent from the description and the accompanying drawings, or may be learned by practice of the invention according to the teachings provided in the description. Problem solutions provided by an embodiment of the present invention will be realized and attained by a flat antenna apparatus particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides a flat antenna apparatus as follows.

[Means for Solving a Subject Problem]

The flat antenna apparatus includes an antenna element pattern, a ground pattern, and a filter that includes two or more stages of filter elements that are electrically connected, wherein the filter elements are stacked. Further, the filter structured as described above and the ground pattern are stacked.

[Effectiveness of Invention]

By stacking the filter elements, an installation area required of the filter is reduced. Further, since the filter and the ground pattern are stacked, the installation area required of the flat antenna apparatus is reduced to a sum of areas required of the antenna element pattern and the ground pattern.

DESCRIPTION OF THE PREFERRED EMBODIMENTS

In the following, embodiments of the present invention are described with reference to the accompanying drawings.

Embodiment 1

Figure 3:
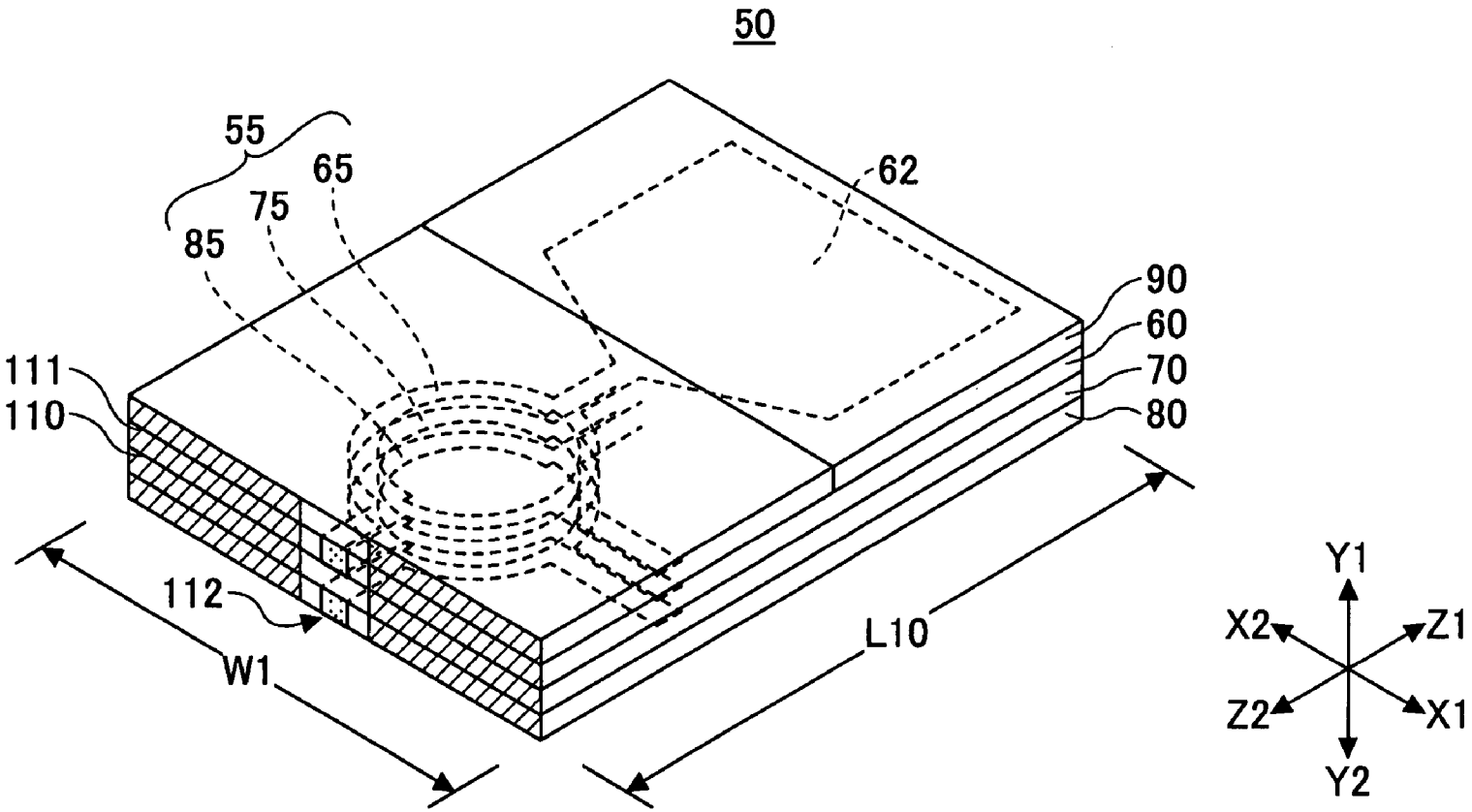
FIG. 3 is a perspective diagram of a UWB flat antenna apparatus according to Embodiment 1 of the present invention.
Figure 4:
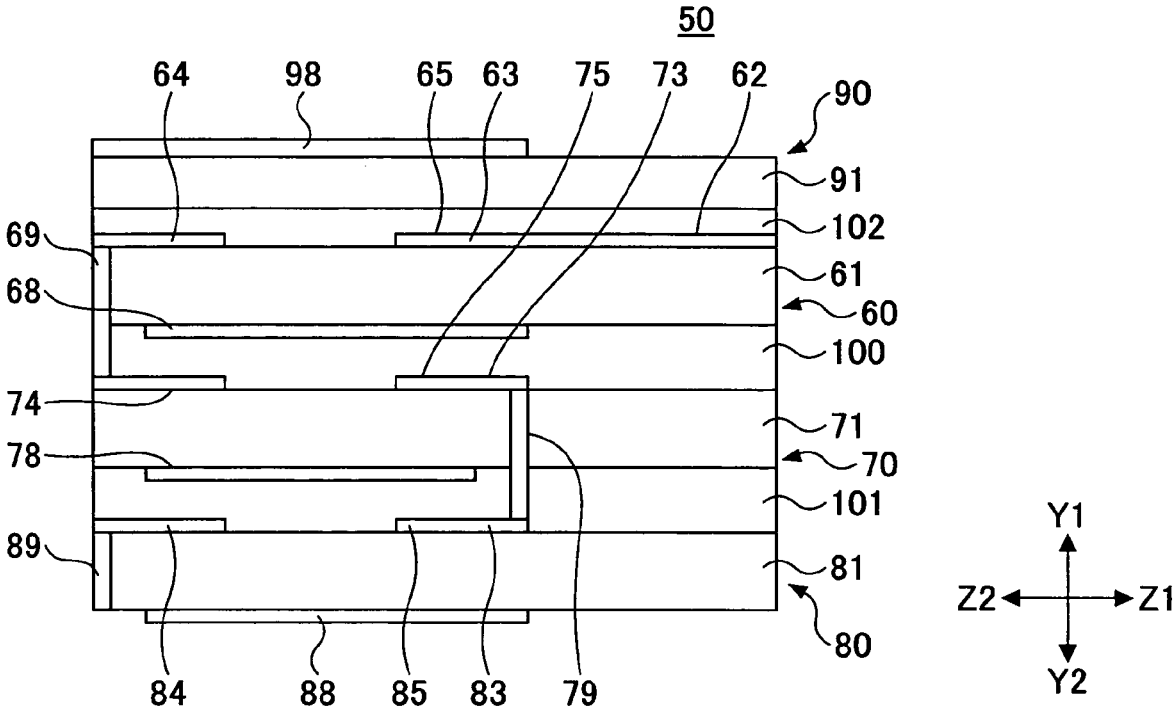
FIG. 4 is a cross-sectional diagram of the UWB flat antenna apparatus shown by FIG. 3.

FIGS. 3 and 4 show a UWB flat antenna apparatus 50 according to Embodiment 1 of the present invention. As for axial directions, Z1-Z2 directions are axial (longitudinal) directions of the UWB flat antenna apparatus 50, Y1-Y2 are thickness directions, and X1-X2 are width directions. FIG. 4 is a cross-sectional diagram showing the UWB flat antenna apparatus 50 expanded in the thickness directions.

Figure 5:
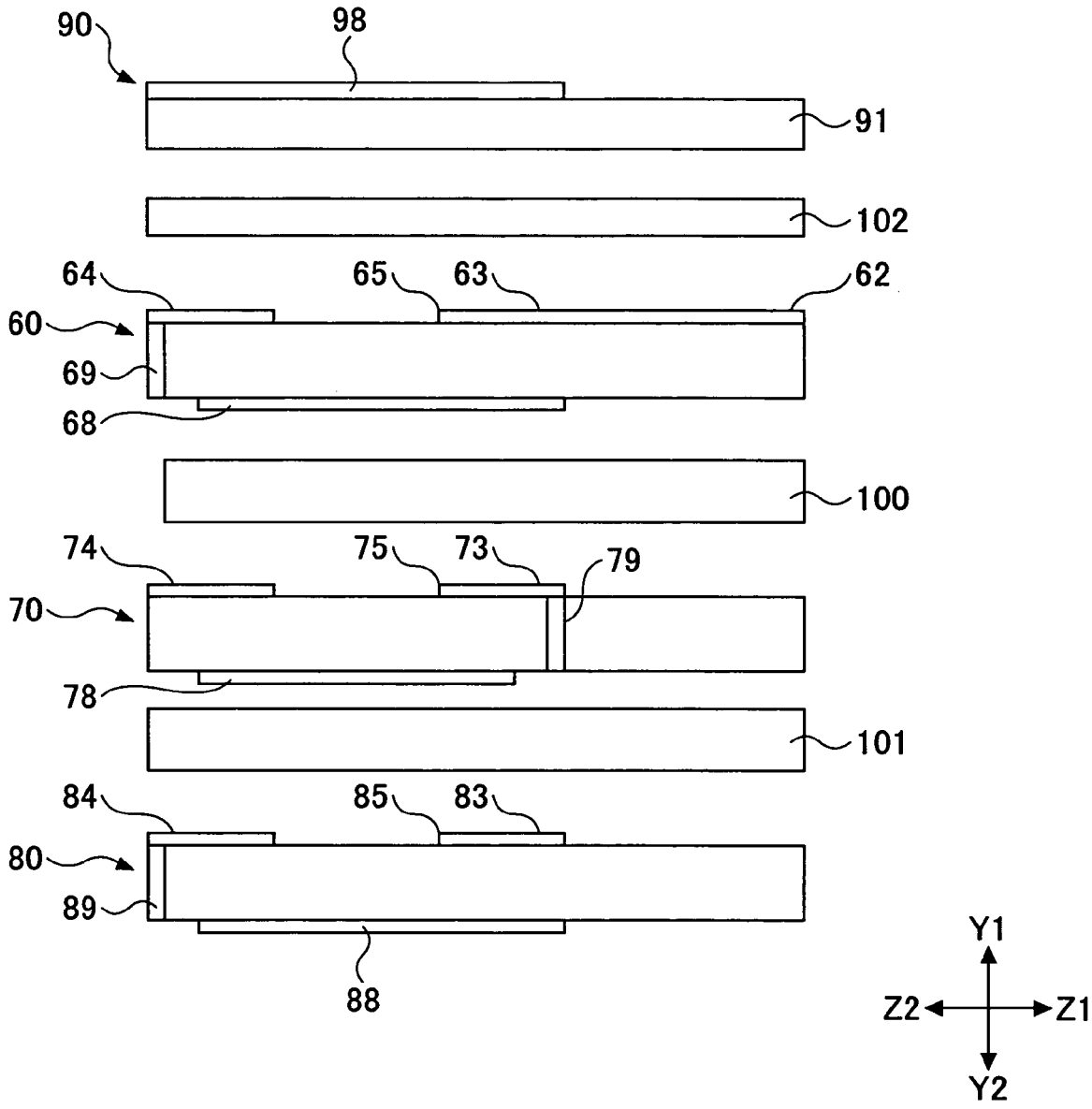
FIG. 5 is a cross-sectional diagram showing each layer of the UWB flat antenna apparatus shown by FIG. 3.
Figure 6:
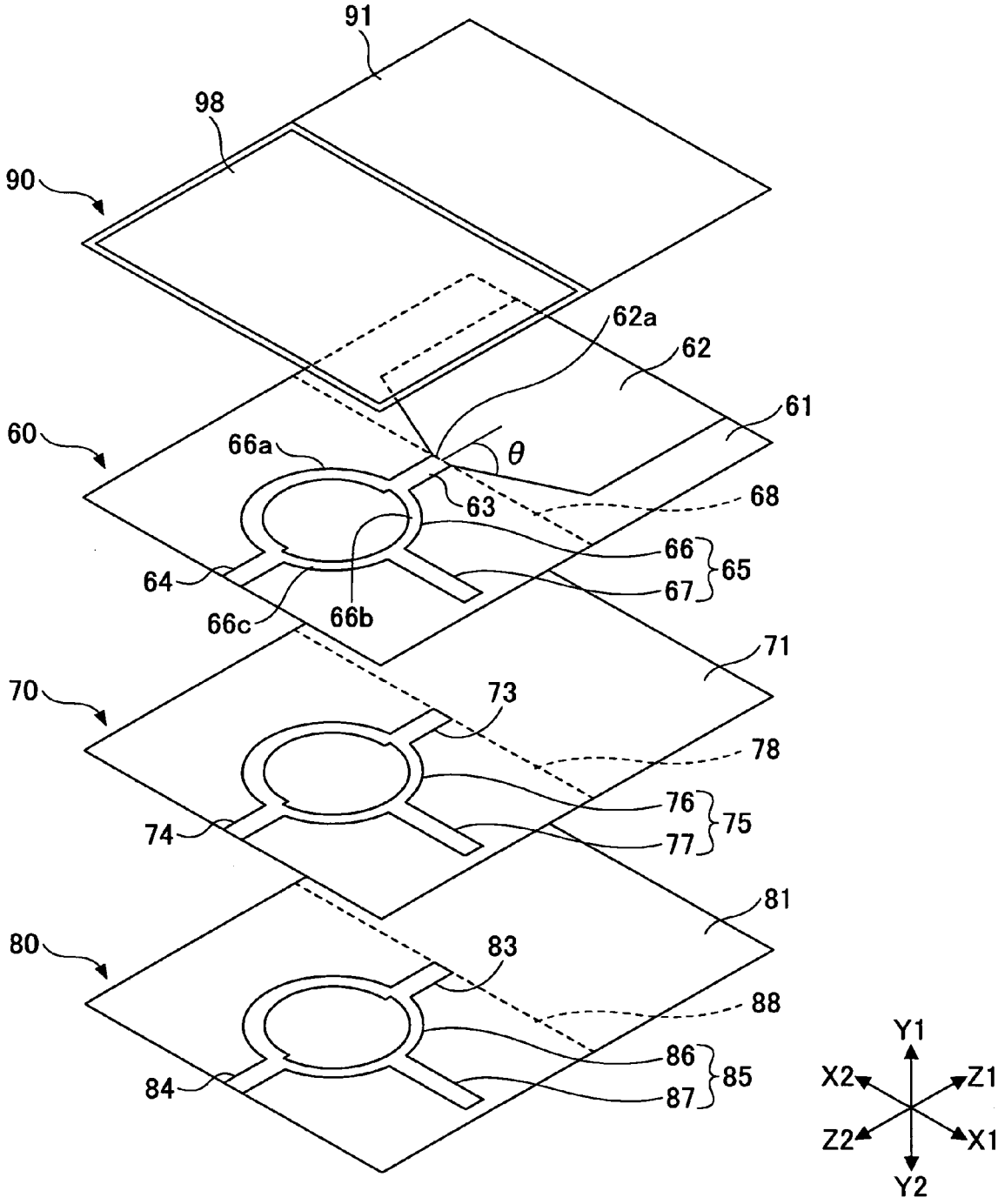
FIG. 6 is an exploded perspective diagram showing each layer of the UWB flat antenna apparatus shown by FIG. 3.

The UWB flat antenna apparatus 50 includes a three-stage ring filter 55 with stubs, and essentially has four layers as shown in FIGS. 5 and 6. The layers include a first sheet 60. On the Y2 direction side of the first sheet 60, a sheet 70 is laminated through a prepreg 100; further, a third sheet 80 is laminated through a prepreg 101. On the Y1 side of the first sheet 60, a fourth sheet 90 is laminated through a prepreg 102.

The ring filter 55 with stubs includes three ring filter elements with stubs, namely, a ring filter element 65 with a stub serving as the first stage, a ring filter element 75 with a stub serving as the second stage, and a ring filter element 55 with a stub serving as the third stage. The ring filter elements 65, 75, and 85 with stubs are electrically connected in series, and are stacked as seen from above (the Y1 direction). Further, the ring filter 55 and ground patterns 68, 78, and 88 are stacked as seen from above (the Y1 direction). Further, the UWB flat antenna apparatus 50 includes an antenna element pattern 62 that is arranged close to the ring filter element 65 with stub. Accordingly, the size of the UWB flat antenna apparatus 50 is approximately the sum of the antenna element pattern 62 and the ring filter element 65 with stub, where the length of the UWB flat antenna apparatus 50 is L10 and width is W1. Since L10 is less than L1 (FIG. 2), an installation area L1O×W1 required of the UWB flat antenna apparatus 50 is less than an installation area L1×W1 required of the conventional apparatus shown in FIG. 2.

Figure 8:
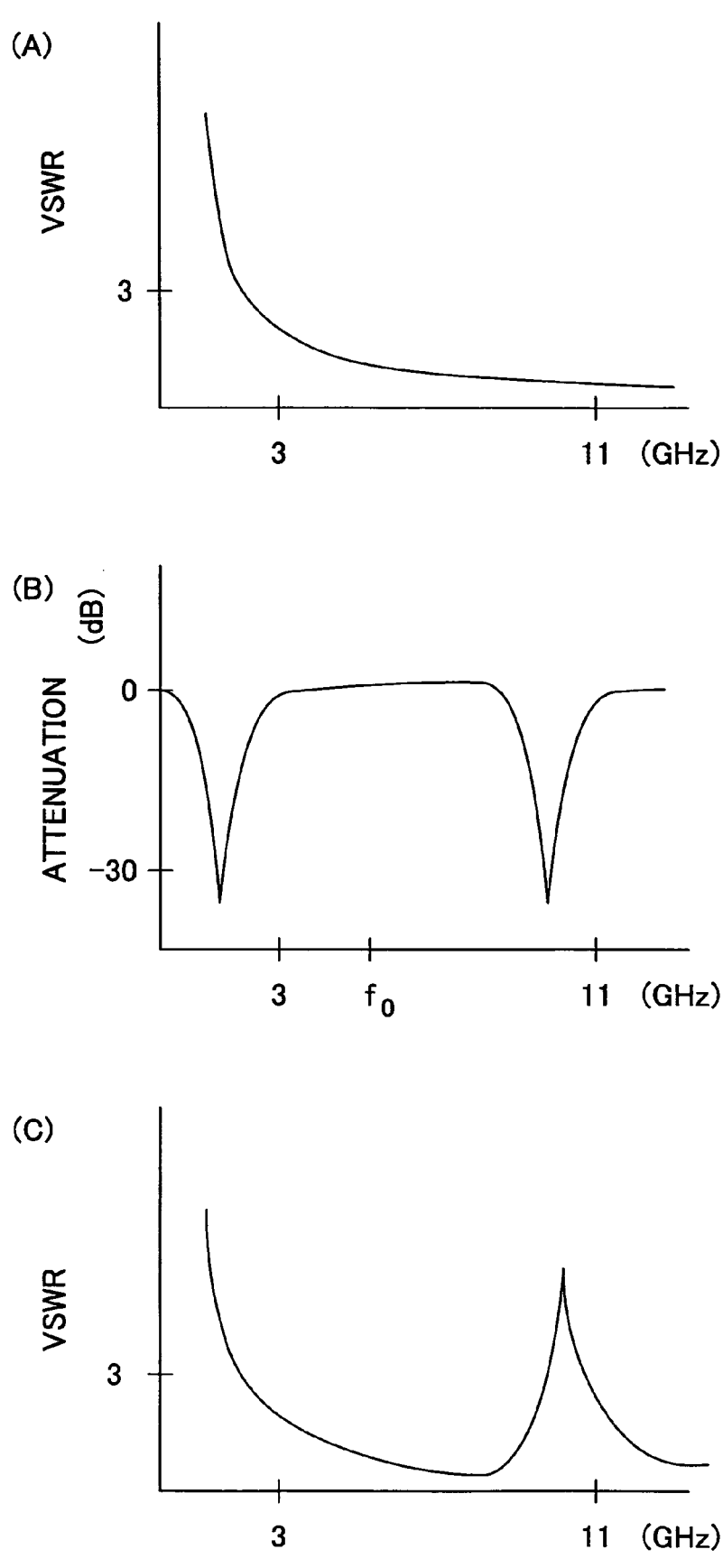
FIG. 8 gives graphs showing characteristics of the UWB flat antenna and a ring filter.

Here, the ring filter 55 with stubs in three stages has a band eliminating characteristic with a center frequency f0 corresponding to a wave length λ as shown by a graph (B) in FIG. 8, wherein attenuation pole frequencies are symmetrically arranged centered on f0.

As shown in FIGS. 6 and 5, the first sheet 60 includes a sheet member 61. On the upper surface of the sheet member 61 are formed an antenna element pattern 62, a line 63, a line 64, and the ring filter element 65 with stub serving as the first stage. Further, the ground pattern 68 is formed on the undersurface of the sheet member 61, and a through-hole plug 69 is formed at the end of the line 64. The antenna element pattern 62 has a projecting section 62*a* (apex) that serves as a feeding point, and an opening angle of the projecting section 62*a* is about 60°. The line 63 is extended in the Z2 direction from the projecting section 62*a* of the antenna element pattern 62. The ring filter element 65 with stub of the first stage includes a ring section 66 and an open stub section 67. The ring section 66 includes a path section 66*a* that is λ/2 long, and path sections 66*b* and 66*c*, each being λ/4 long. Here, λ is the wavelength corresponding to the frequency f0. The width of the path section 66*a* is greater than the width of the path sections 66*b* and 66*c*. The ring section 66 is located between the line 63 and the line 64. The ground pattern 68 is formed in an area except the section corresponding to the antenna element pattern 62, and is a square shape.

The second sheet 70, which has the same dimensions as the first sheet 60, includes a sheet member 71. In a section toward the end in the Z2 direction of the upper surface of the sheet member 71 are formed a line 73, a line 74, and the ring filter element 75 with stub serving as the second stage. On the undersurface of the sheet member 71 the ground pattern 78 is formed, and a through-hole plug 79 is formed at the end of the line 73. The ring filter element 75 with stub of the second stage includes a ring section 76 and an open stub section 77. The ring section 76 is located between the line 73 and the line 74. The ground pattern 78 has the same dimensions as the ground pattern 68, and is square in shape.

The third sheet 80, made the same as the second sheet 70, includes a sheet member 81. On the upper surface of the sheet member 81 are formed a line 83, a line 84, and the ring filter element 85 with stub serving as the third stage. The ground pattern 88 is formed on the undersurface of the sheet member 81, and a through-hole plug 89 is provided at the end of the line 84. The ring filter element 85 with stub of the third stage includes a ring section 86 and an open stub section 87. The ring section 86 is located between the line 83 and the line 84. The ground pattern 88 has the same dimensions as the ground pattern 78, and is square in shape.

The fourth sheet 90 has the same dimensions as the first sheet 60, and includes a sheet member 91. In a section on a side in the Z2 direction of the upper surface of the sheet member 91, a ground pattern 98 is provided. The ground pattern 98 has the same dimensions as the ground pattern 68, and is square in shape.

In FIG. 6 illustration of the through-hole plugs 69, 79, and 89 of the sheets 60, 70, and 80, respectively, and through-hole plugs for connecting the ground patterns 68, 78, 88, and 98 is omitted for convenience of illustration.

As described above, the UWB flat antenna apparatus 50 shown in FIGS. 3 and 4 is structured by laminating the sheets 60, 70, 80, and 90 with the prepregs 100, 101 and 102. In addition, when manufacturing the UWB flat antenna apparatus 50, sheets in a greater size are stacked, and are sliced into pieces.

A ground pattern 111 is formed on a side 110 in the Z2 direction of the UWB flat antenna apparatus 50, except for sections where the through holes 69 and 89 are present.

The through-hole plug 89 serves as a contact point of the UWB flat antenna apparatus 50. The path from the antenna element pattern 62 to the through-hole plug 89 is folded, and is formed in three dimensions. Namely, the path goes from the antenna element pattern 62 to the line 63, to the ring filter-element 65 with stub serving as the first stage, to the line 64, to the through-hole plug 69, to the line 74, to the ring filter-element 75 with stub serving as the second stage, to the line 73, to the through-hole plug 79, to the line 83, to the ring filter-element 85 with stub serving as the third stage, to the line 84, and to the through-hole plug 89.

The ring filter element 65 with stub of the first stage, the ring filter element 75 with stub of the second stage, and the ring filter element 85 with stub of the third stage are connected in series. This constitutes the three stages of the ring filter 55 with stubs.

Here, the lines 63 and 64 are located between the ground pattern 98 and the ground pattern 68, and have a strip line configuration with impedance of 50Ω. Similarly, the lines 74 and 73 are located between the ground pattern 68 and the ground pattern 78, and have the strip line configuration with the impedance of 50Ω. Similarly, the lines 84 and 83 are located between the ground pattern 78 and the ground pattern 88, and have the strip line configuration with the impedance of 50Ω.

Figure 7:
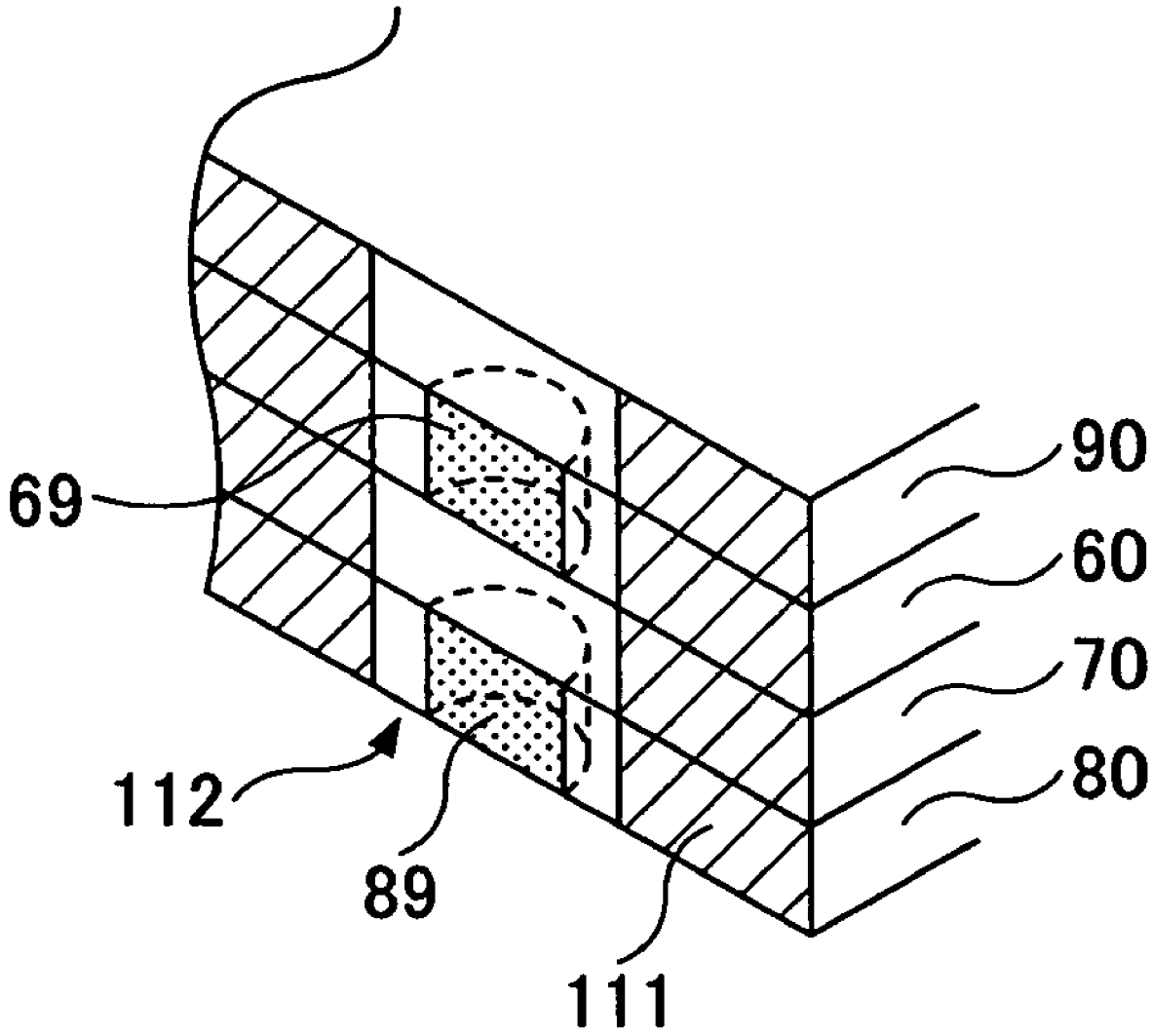
FIG. 7 is a perspective diagram expanding and showing a section of the UWB flat antenna apparatus shown by FIG. 3.

FIG. 7 is an expanded view of the through-hole plugs 69 and 89 with their vicinity. The through-hole plugs 69 and 89 with the ground pattern 111 on both sides serve as a coplanar line type microwave transmission line 112 whose impedance is 50Ω. Here, the through-hole plugs 69 and 89 are formed when the large size sheets that are laminated are sliced into pieces, are thereby exposed in the cutting plane, and have the shape of a semicircular pilaster.

The ring filter elements 65, 75, and 85 with stubs are stacked in the Y2-Y1 directions. Further, the ring filter elements 65, 75, and 85 with stubs are stacked with the ground patterns 68, 78, 88, and 98 in the Y2-Y1 directions. Accordingly, the installation area required for the UWB flat antenna apparatus 50 is reduced to the sum of installation areas required for the antenna element pattern 62 and one of the ring filter elements with stub such as the ring filter element 65 with stub. In this way, the UWB flat antenna apparatus 50 is miniaturized.

The ring filter elements 65, 75, and 85 with stubs are closely stacked so that mutual coupling tends to occur. Accordingly, the mutual coupling is prevented by providing the ground pattern 68 between the ring filter element 65 with stub and the ring filter element 75 with stub; and by providing the ground pattern 78 between the ring filter element 75 with stub and the ring filter element 85 with stub.

The ground patterns 68, 78, and 88 and 98 are each electrically connected by a through-hole plug that is not illustrated. Further, the ground pattern 111 is electrically connected to an end of each of the ground patterns 68, 78, 88, and 98.

A coaxial cable (not illustrated) is connected to the UWB flat antenna apparatus 50. For example, the core of the coaxial cable is soldered to the through-hole plug 89, and the mesh is soldered to the ground pattern 111. A high frequency signal is provided through the coaxial cable to the through-hole plug 89, is transmitted through the path described above, and is provided to the antenna element pattern 62. Here, the potential of the ground patterns 68, 78, 88, and 98 is ground level. Accordingly, electric lines of force are formed between the antenna element pattern 62 and one or more of the ground patterns 68, 78, 88, and 98, and an electric wave is transmitted from the antenna element pattern 62. In reverse, an electric wave signal received by the antenna element pattern 62 passes through the path including the ring filter elements 65, 75, and 85 with stubs, and is provided to the coaxial cable.

With reference to FIG. 8, VSWR (Voltage Standing Wave Ratio) vs. frequency characteristics of the UWB flat antenna apparatus 50 where no ring filters with stubs are provided are shown at (A); band path characteristics with the three-stage ring filter 55 with stubs are shown at (B); and VSWR-frequency characteristics of the UWB flat antenna apparatus 50 with the three-stage ring filter 55 with stub are shown at (C). That is, desired VSWR-frequency characteristics are obtained with the three-stage ring filter 55.

In summary, the desired characteristics of the UWB flat antenna apparatus 50 are obtained by all the lines 63 being configured not as micro strip lines but as strip lines, the section of the through-hole plugs 69 and 89 being exposed on the side face, and serving as the coplanar line type microwave transmission line 112, mutual coupling of the ring filter elements 65, 75, and 85 with stubs being prevented by the ground patterns 68 and 78, and the ground pattern 98 shielding the line 63, the ring filter element 65 with stub, and the line 64, and the like.

In addition, the size of the sheet 90 may be made smaller such that the antenna element pattern 62 is exposed.

Embodiment 2

Figure 9:
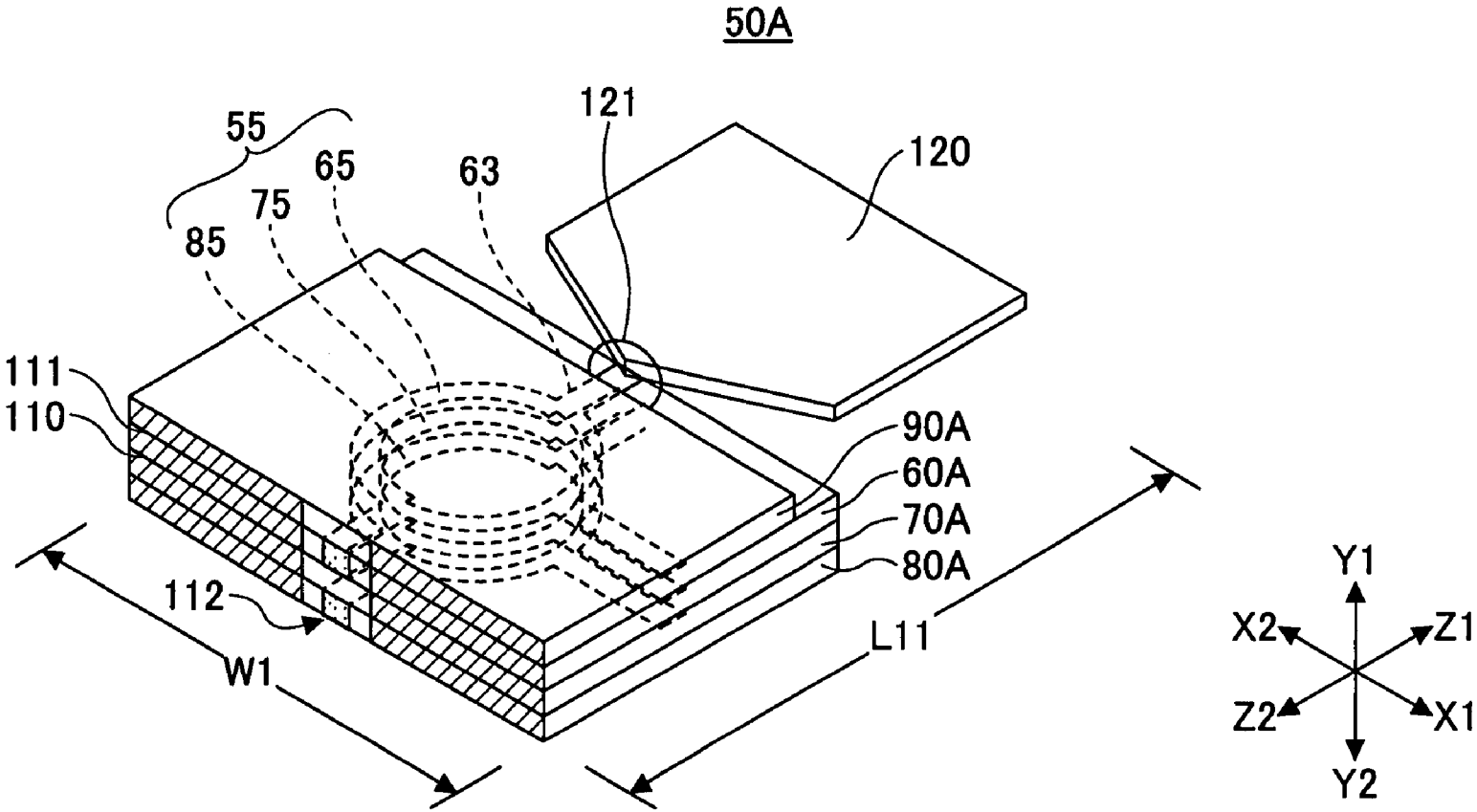
FIG. 9 is a perspective diagram of the UWB flat antenna apparatus according to Embodiment 2 of the present invention.
Figure 10:
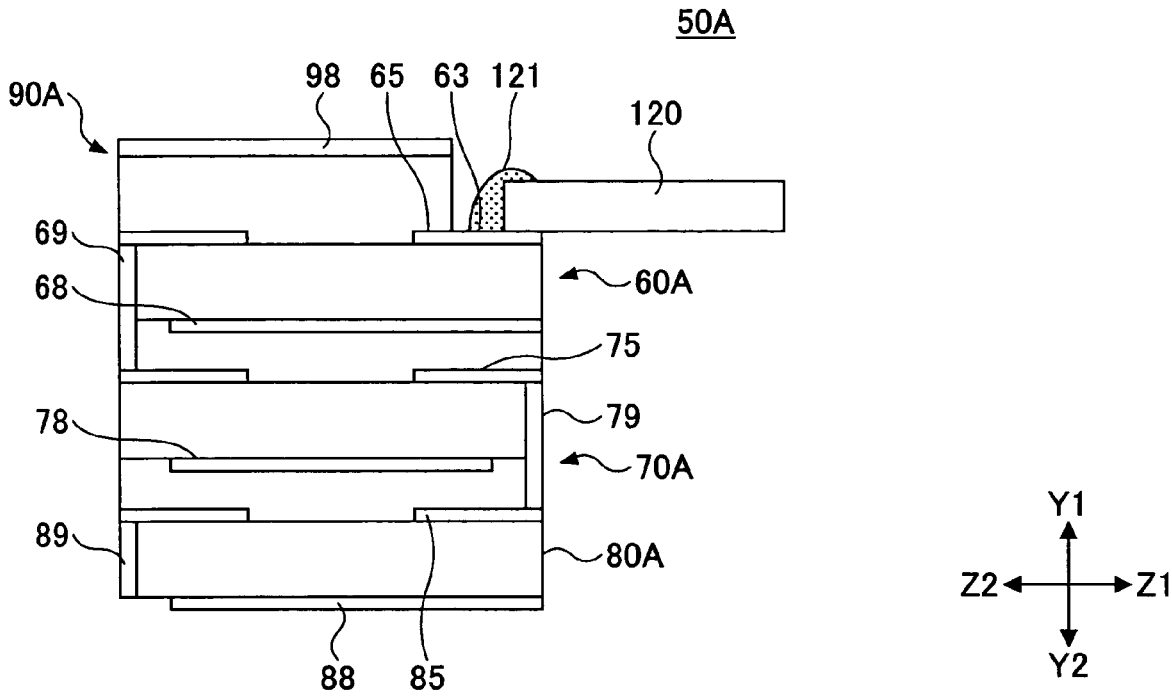
FIG. 10 is a cross-sectional diagram of the UWB flat antenna apparatus shown by FIG. 9.

FIGS. 9 and 10 show a UWB flat antenna apparatus 50A according to Embodiment 2 of the present invention. As for axial directions, Z1-Z2 directions are the axial directions of the UWB flat antenna apparatus 50A, X1-X2 are width directions, and Y1-Y2 are thickness directions.

Differences between the UWB flat antenna apparatus 50A, which includes the three-stage ring filter with stubs, and the UWB flat antenna apparatus 50 as shown by FIGS. 3 and 4 include the following points.

The UWB flat antenna apparatus 50A includes an antenna element member 120 instead of the antenna element pattern 62. The UWB flat antenna apparatus 50A includes sheets 60A, 70A, 80A, and 90A instead of the sheets 60, 70, 80, and 90, respectively. A portion corresponding to the antenna element pattern 62 is excised from the sheets 60, 70, 80, and 90 to obtain the sheets 60A, 70A, 80A, and 90A, respectively. A projecting section (feeding point) of the antenna element member 120 is connected to the end of the line 63 with solder 121.

Figure 1A:
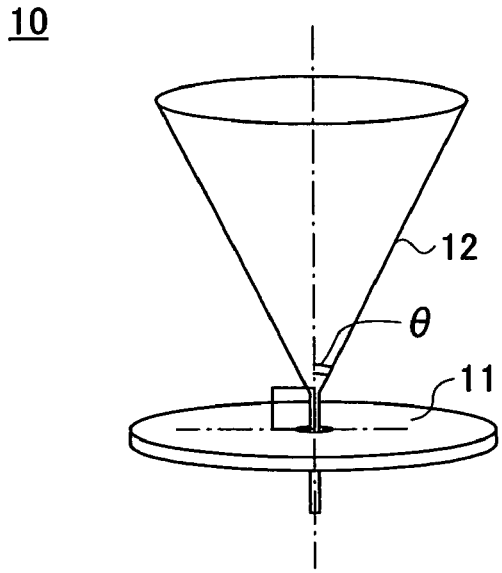
FIG. 1A and FIG. 1B are perspective diagrams of examples of conventional antenna apparatuses.
Figure 1B:
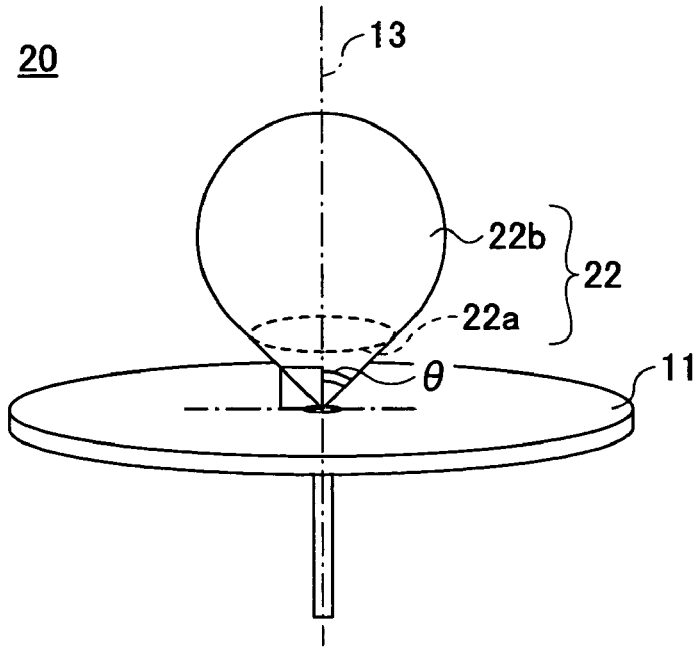
Figure 2:
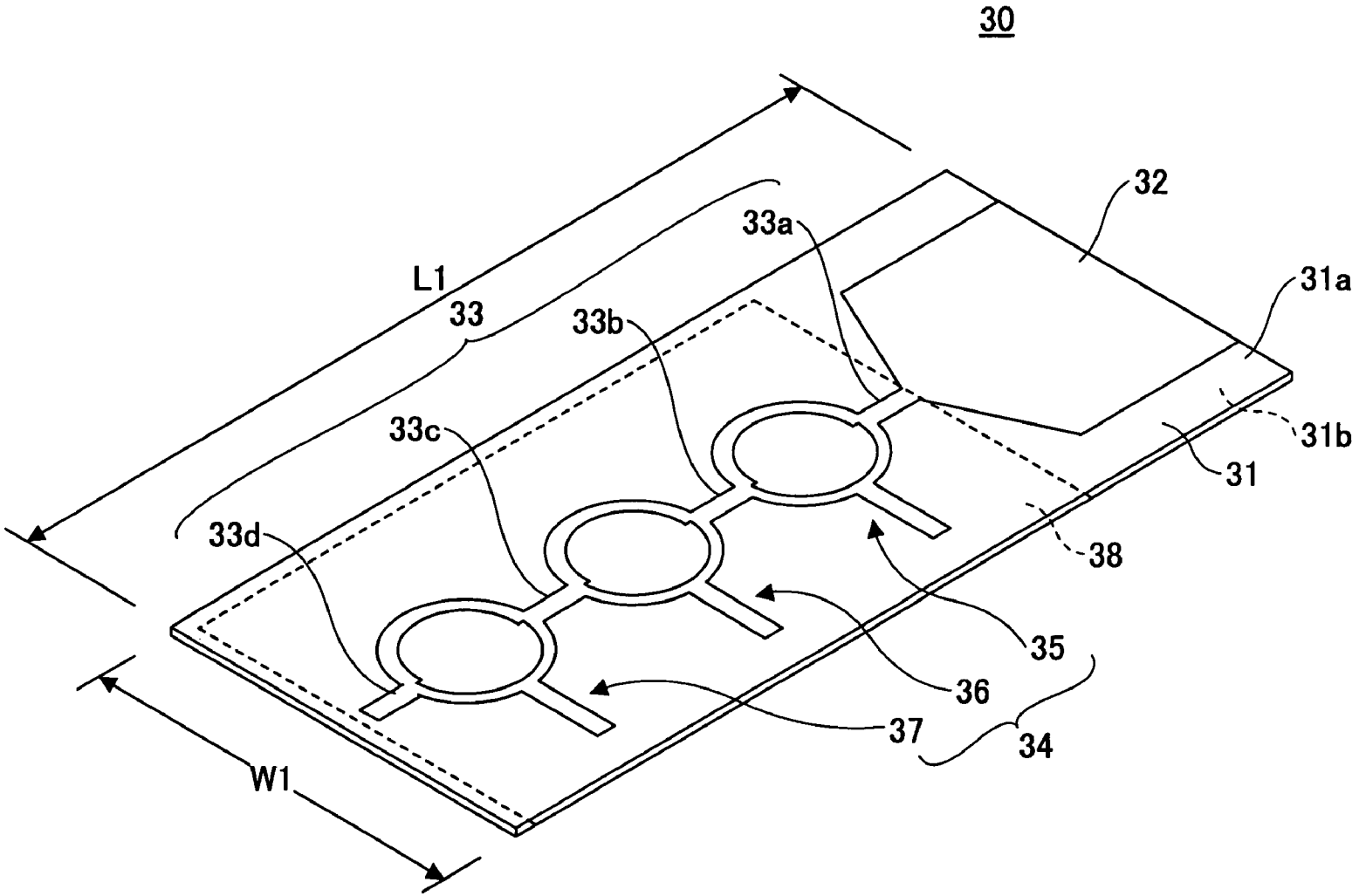
FIG. 2 is a perspective diagram of a UWB flat antenna apparatus, a patent application for which has been filed by the applicant hereto.

Dimensions of the UWB flat antenna apparatus 50A are L11×W1, where L11<L1; that is, the dimensions are less than the conventional UWB flat antenna apparatus 30 shown in FIG. 2.

Figure 11:
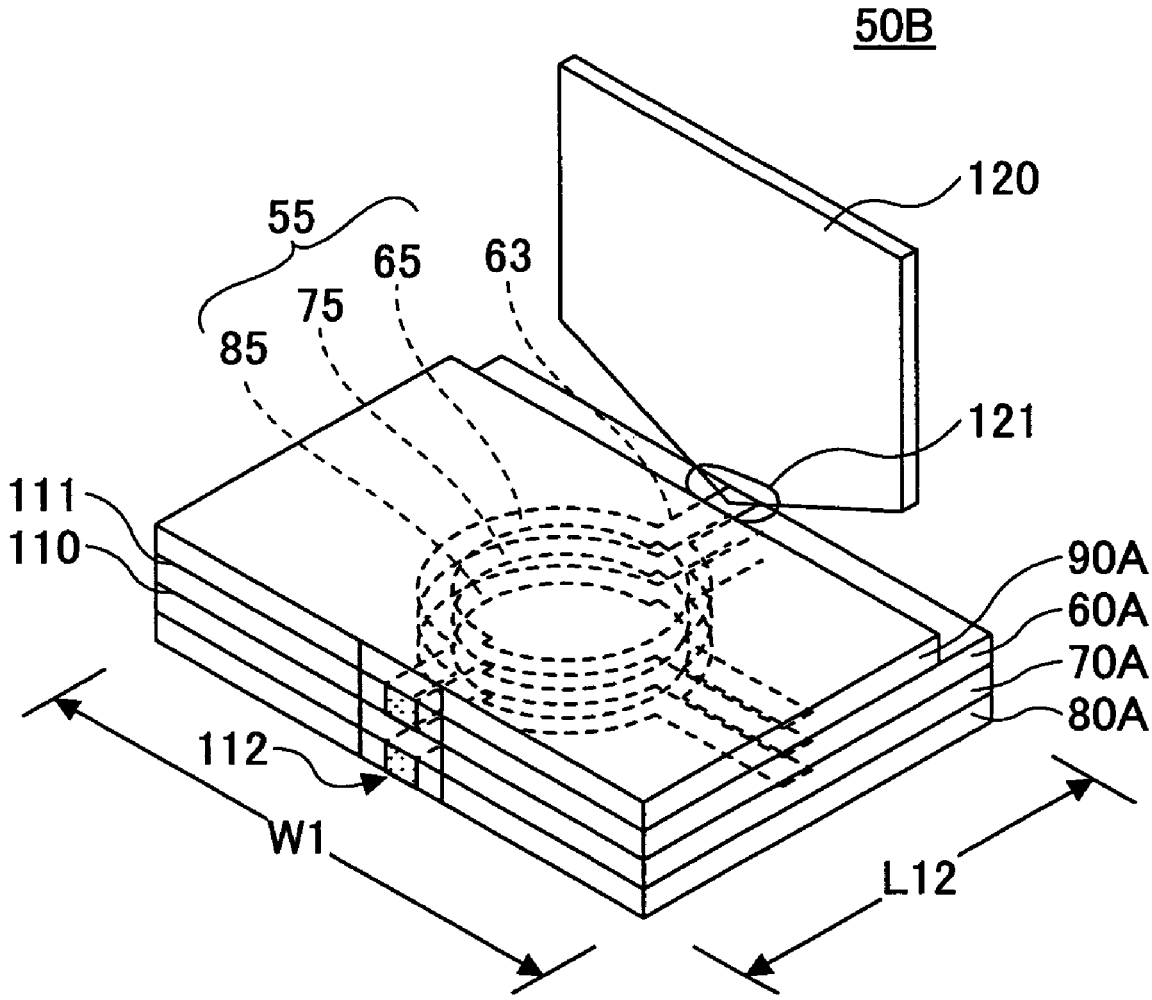
FIG. 11 is a perspective diagram showing a modification of the UWB flat antenna apparatus shown by FIG. 9.

FIG. 11 shows a UWB flat antenna apparatus 50B that is a modification of the UWB flat antenna apparatus 50A. Here, an antenna element member 120 is vertically folded. Dimensions of the UWB flat antenna apparatus 50B are L12×W1, where L12<L1. Accordingly, the UWB flat antenna apparatus 50B is smaller than the UWB flat antenna apparatus 50A shown in FIG. 9.

Embodiment 3

Figure 12:
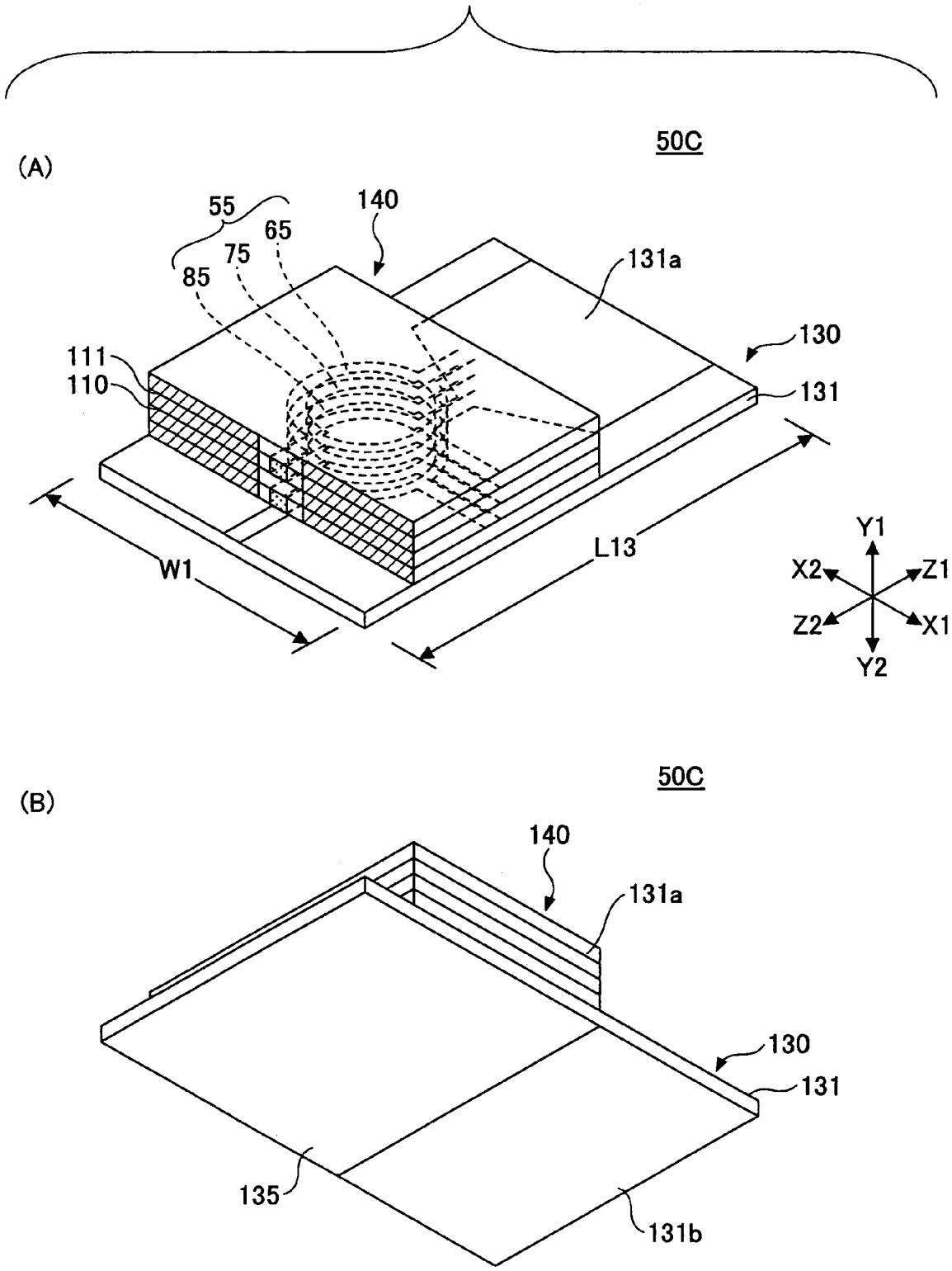
FIG. 12 is a perspective diagram of the UWB flat antenna apparatus according to Embodiment 3 of the present invention.
Figure 13:
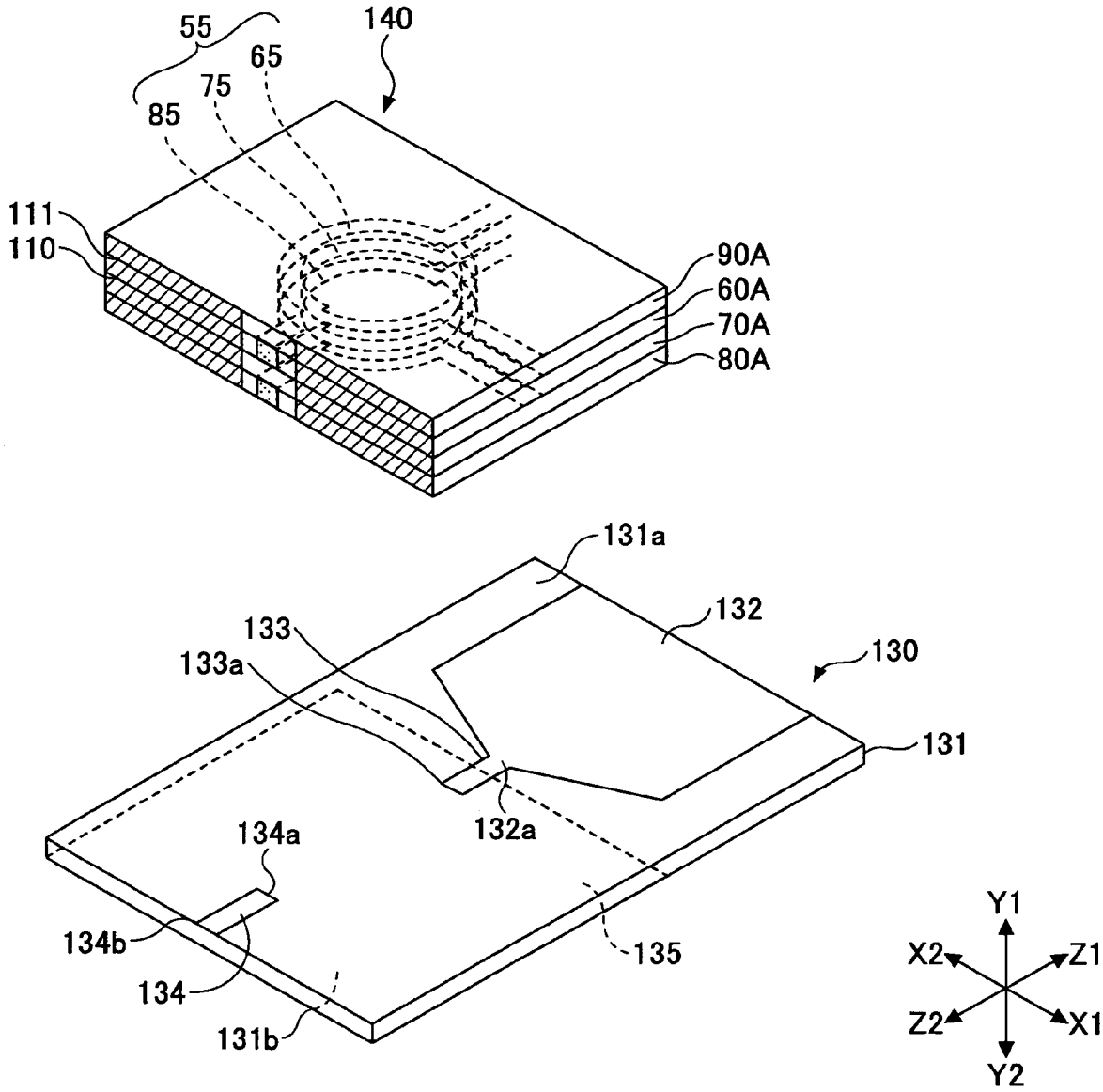
FIG. 13 is an exploded perspective diagram of the UWB flat antenna apparatus shown by FIG. 12.

FIG. 12 shows a UWB flat antenna apparatus 50C according to Embodiment 3 of the present invention. FIG. 13 gives an exploded view showing the UWB flat antenna apparatus 50C.

The UWB flat antenna apparatus 50C includes a flat antenna body 130 and a three-stage ring filter component 140 that includes the three-stage ring filter 55 with stubs mounted on the upper surface of the flat antenna body 130.

With reference to FIG. 13, the flat antenna body 130 includes an antenna element pattern 132, a line 133, a line 134 formed on an upper surface 131*a* of a substrate 131 made from dielectric material. On an undersurface 131*b* of the substrate 131 a ground pattern 135 is formed in the shape of a square as shown in FIG. 13. The line 133 is prolonged from a projecting part (feeding point) 132*a* of the antenna element pattern 132, and has a terminal section 133*a* on the other end.

The line 134 is formed on the Z2 end of the substrate 131, and has terminal sections 134*a* and 134*b* on corresponding ends. The three-stage ring filter component 140 with stubs is mounted between the line 133 and the line 134.

The three-stage ring filter component 140 with stubs is generally configured by the lamination of the sheets 60A, 70A, 80A, and 90A, wherein the ring filter 65 with stub of the first stage, the ring filter element 75 with stub of the second stage, and the ring filter element 85 with stub of the third stage are connected with the corresponding lines, and includes terminals (not illustrated) arranged near the edges of the undersurface.

The terminals (not illustrated) arranged on the undersurface of the three-stage ring filter component 140 with stubs are connected to the terminal section 133*a* and the terminal section 134*a* so that the three-stage ring filter component 140 is mounted on the upper surface of the flat antenna body 130.

Dimensions of the UWB flat antenna apparatus 50C are L13×W1, where L13<L1, which are smaller than those of the UWB flat antenna apparatus 30 shown in FIG. 2.

Embodiment 4

Figure 14:
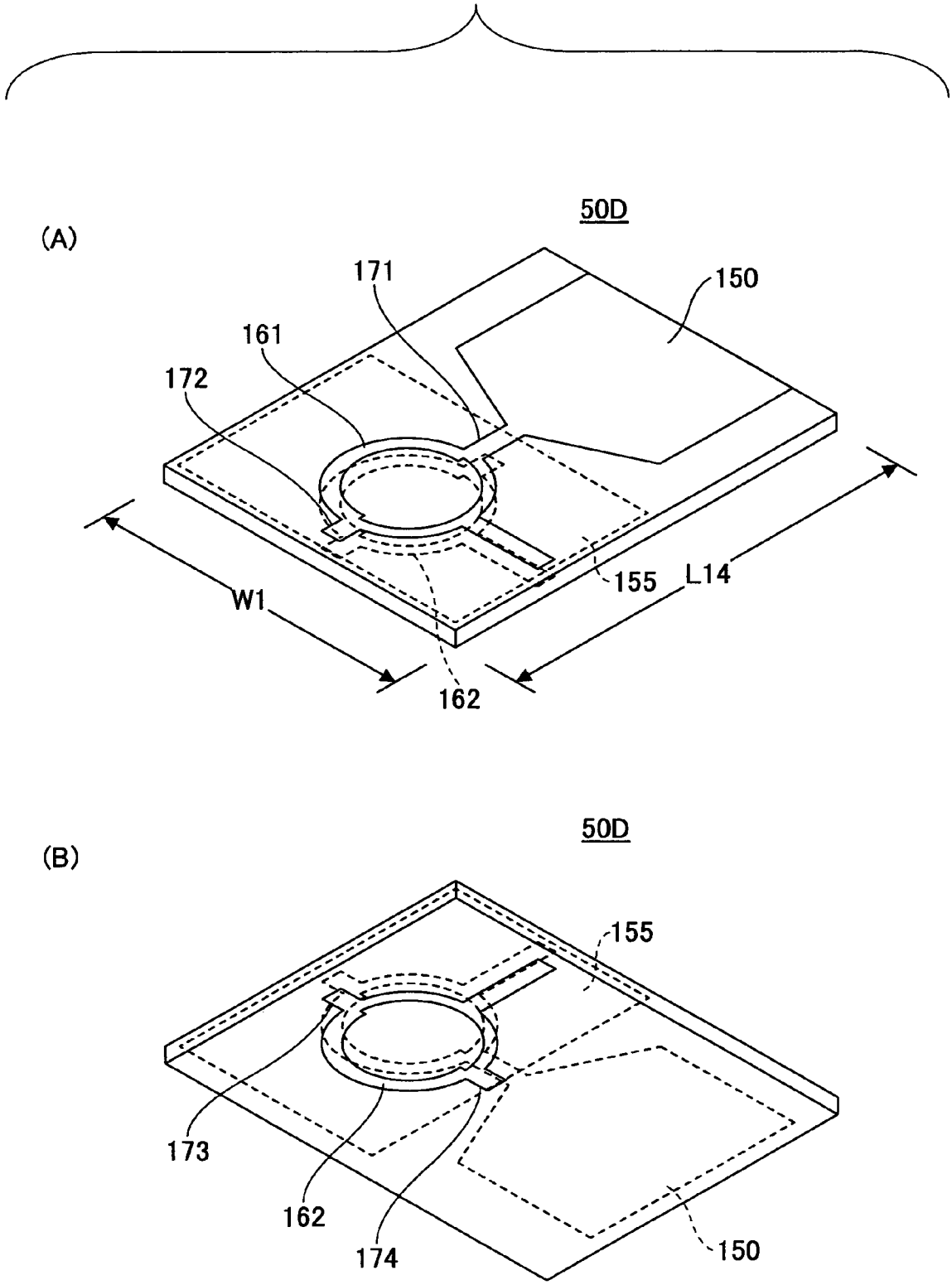
FIG. 14 is a perspective diagram of the UWB flat antenna apparatus according to Embodiment 4 of the present invention.
Figure 15:
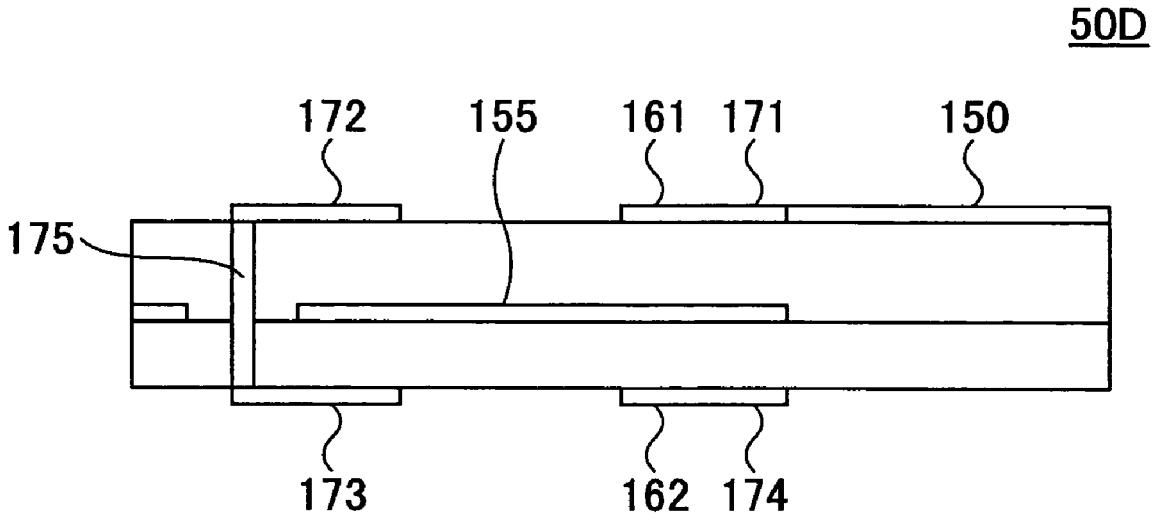
FIG. 15 is a cross-sectional diagram of the UWB flat antenna apparatus shown by FIG. 14.
Figure 16:
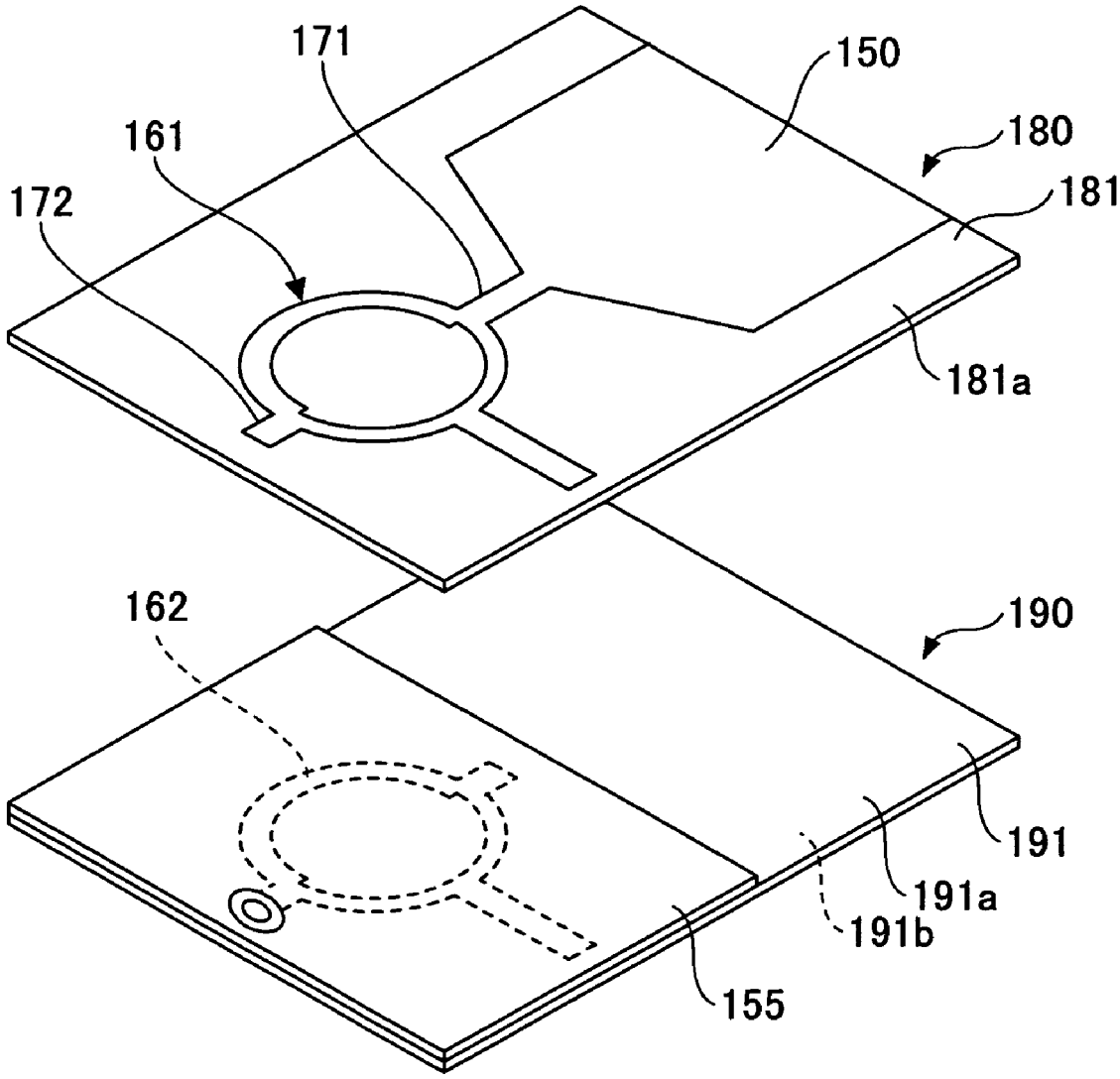
FIG. 16 is an exploded perspective diagram of the UWB flat antenna apparatus shown by FIG. 14.

FIG. 14 and FIG. 15 show a UWB flat antenna apparatus 50D according to Embodiment 4 of the present invention. FIG. 16 gives an exploded perspective view of the UWB flat antenna apparatus 50D.

The UWB flat antenna apparatus 50D includes a two-stage ring filter with stubs, wherein an antenna element pattern 150, a line 171, a line 172, and a ring filter element 161 with stub serving as the first stage are arranged on the upper surface. A ground pattern 155 is arranged in an inner layer. On the undersurface are arranged a line 173, a line 174, and a ring filter element 162 with stub serving as the second stage. The line 172 and the line 173 are connected at a through-hole plug 175. The ring filter element 161 with stub of the first stage and the ring filter element 162 with stub of the second stage are connected in series.

The UWB flat antenna apparatus 50D is manufactured by laminating and fixing a first sheet 180 to the upper surface of a second sheet 190 as shown in FIG. 16. Here, the first sheet 180 includes the antenna element pattern 150 and the ring filter element 161 with stub of the first stage on an upper surface 181*a* of a sheet member 181. Further, the second sheet 190 includes the ground pattern 155 on an upper surface 191*a* of a sheet member 191; and the ring filter element 162 with stub of the second stage on an undersurface 191*b*.

Dimensions of the UWB flat antenna apparatus 50D are L14×W1, where L14<L1; accordingly, the UWB flat antenna apparatus 50D is smaller than the UWB flat antenna apparatus 30 shown in FIG. 2.

Further, the present invention is not limited to these embodiments, but variations and modifications may be made without departing from the scope of the present invention.

The present application is based on Japanese Priority Application No. 2006-131699 filed on May 10, 2006 with the Japanese Patent Office, the entire contents of which are hereby incorporated by reference.

What is claimed is:

1. A flat antenna apparatus, comprising:

an antenna element pattern;

a ground pattern; and a multiple-staged filter including a plurality of filter elements, wherein:

the filter elements are electrically connected in series and are stacked;

the multiple-stage filter and the ground pattern are stacked; and the ground pattern is inserted between an adjacent pair of the filter elements.

2. The flat antenna apparatus as claimed in claim 1, wherein the filter elements are electrically connected in series by a strip line.

3. The flat antenna apparatus as claimed in claim 1, wherein the antenna element pattern is replaced with a plate-like antenna element member.

4. The flat antenna apparatus as claimed in claim 1, wherein:

the filter is a filter component wherein filter elements are electrically connected in series and are stacked, and the filter component is mounted on a flat antenna body on which the antenna element pattern and the ground pattern are formed.

5. The flat antenna apparatus as claimed in claim 1, wherein:

the ground pattern is formed in an inner layer of a substrate, and the filter elements are formed on an upper surface and an undersurface of the substrate.

6. A method of forming a flat antenna, comprising:

providing an antenna element pattern;

stacking a plurality of filter elements to form a multiple-staged filter;

connecting the filter elements electrically in series;

stacking the multiple-stage filter and a ground pattern; and inserting the ground pattern between an adjacent pair of the filter elements.

* * * * *

UNITED STATES PATENT AND TRADEMARK OFFICE

CERTIFICATE OF CORRECTION

PATENT NO. : 7,557,756 B2
APPLICATION NO. : 11/590743
DATED : July 7, 2009
INVENTOR(S) : Hideki Iwata et al.

It is certified that error appears in the above-identified patent and that said Letters Patent is hereby corrected as shown below:

Title page, item [73] (Assignee), Line 1, change "Limted," to --Limited,--.

Title page, Column 2 (Primary Examiner), Line 1, change "HoangAhn T Le" to --HoangAnh T Le--.

Signed and Sealed this

Twentieth Day of October, 2009

David J. Kappos

David J. Kappos
*Director of the United States Patent and Trademark Office*